United States Patent [19]

Courvoisier et al.

[11] Patent Number: 4,761,898

[45] Date of Patent: Aug. 9, 1988

[54] FOOTWEAR FASTENER AND SKI BOOT EQUIPPED THEREWITH

[75] Inventors: Guy Courvoisier, Celigny; Simon Arieh, Geneva, both of Switzerland; Herbert Marxer, Schaan, Liechtenstein

[73] Assignee: Lange International S.A., Fribourg, Switzerland

[21] Appl. No.: 23,214

[22] Filed: Mar. 9, 1987

[30] Foreign Application Priority Data

Apr. 18, 1986 [CH] Switzerland ..... 1578/86
Aug. 22, 1986 [CH] Switzerland ..... 3397/86

[51] Int. Cl.[4] ..... A43C 11/00; A43B 5/04

[52] U.S. Cl. ..... 36/50; 36/117; 24/68 SK; 24/71 SK

[58] Field of Search ..... 36/117–121, 36/50; 24/68 SK, 69 SK, 70 SK, 71 SK

[56] References Cited

U.S. PATENT DOCUMENTS

| | | | |
|---|---|---|---|
| 4,229,862 | 10/1980 | Kubelka | 24/68 SK |
| 4,395,801 | 8/1983 | Gabrielli | 36/50 X |
| 4,547,980 | 10/1985 | Olivieri | 36/50 |
| 4,649,657 | 3/1987 | Iwama | 36/117 |
| 4,670,946 | 6/1987 | Olivieri | 36/50 X |
| 4,683,620 | 8/1987 | Valsecchi et al. | 24/71 SK |

*Primary Examiner*—James Kee Chi
*Attorney, Agent, or Firm*—Kane, Dalsimer, Sullivan, Kurucz, Levy, Eisele and Richard

[57] ABSTRACT

This fastener for closing two portions (2, 4) of a footwear in general and more particularly of a ski boot comprises a toothed strap (8) having ratchet teeth which is attached to one portion (2) of the footwear and has mounted permanently thereon a stirrup (10) provided with a pawl (11) and a tension lever (14) pivoted on the stirrup (10) fulcrumed on the other hand on the other portion (4) of the boot, the length of the toothed strap (8) being sufficient to allow a wide opening of the footwear, the fastener being adapted to keep the footwear closed permanently and being easily operated with one hand by the user.

5 Claims, 5 Drawing Sheets

FOOTWEAR FASTENER AND SKI BOOT EQUIPPED THEREWITH

FIELD OF THE INVENTION

The present invention relates to a fastener for closing portions of a footwear, notably sports footwears and more particularly ski boots. This fastener comprises essentially a toothed strap having ratchet teeth which is adapted to be attached to one quarter of the footwear shaft, a stirrup associated with a pawl, adapted to be secured to the other quarter of the footwear shaft and through which the toothed strap is slidably engaged and retained in one axial direction by said pawl, and a tension lever.

THE PRIOR ART

Devices of this character are already widely used in many types of ski boots. In these well-known devices the strirrup carrying the pawl is secured by means of rivets to one quarter of the boot shaft and the toothed strap is secured to an intermediate area of a tension lever fulcrumed at one end on the other quarter of the boot shaft. In these prior art devices the toothed strap is substituted for the buckle of the former devices which engaged hook means rigidly secured to the other quarter of the boot shaft. When the user wishes to close the boot, he must firstly insert the end of the toothed strap into the stirrup associated with the pawl. For this purpose, he must in most cases hold the stirrup with one hand and the strap with the other hand. Now this operation is sometimes rather awkward, especially when the fastener closes from the rear the two-section or split shaft of a ski boot. Moreover, when the boot is open, the toothed strap may tend to move away from the boot and impinge nearby foreign objects.

It is the primary object of the present invention to facilitate the closing of a fastener of the type broadly set forth hereinabove.

SUMMARY OF THE INVENTION

The fastener according to the present invention is characterised in that the stirrup is fitted permanently on the toothed strap and that the tension lever is fulcrumed on the stirrup and provides a permanent connection between the stirrup and the other quarter of the footwear shaft.

To prevent the stirrup from escaping from the toothed strap, it is only necessary to provide the free end of the toothed strap with a widened portion.

Since the stirrup is held permanently on the toothed strap, the user is no longer required to try to find the stirrup inlet with the tip of the toothed strap. Therefore, he can close the boot with only one hand.

In a preferred form of embodiment of the present invention the tension lever is fulcrumed at one end on the stirrup and connected intermediate its length to the other quarter of the boot shaft. With this construction, the tip of the toothed strap which projects from the stirrup can easily be inserted under the other portion of the boot shaft, so that this tip is concealed and protected, and therefore prevented from impinging foreign bodies or objects.

However, it is also possible to cause the tension lever to pivot intermediate its length on the stirrup and at its end on the other quarter of the boot shaft. In this case, however, it is sometimes difficult to cause the toothed strap to pass under the boot portion supporting the tension lever.

According to another possible form of embodiment of the present invention, the pawl is provided with an auxiliary nose extending in the direction of the pivot pin of the lever in the stirrup, and the tension lever comprises a curved, finger-like extension beyond its pivot pin on said stirrup, which is directed toward the toothed strap and the pawl, so that after opening the tension lever this curved finger can engage the auxiliary nose of the pawl and move this pawl away from the toothed strap. The lever arm ratio is such that after opening the tension lever the pawl can be moved very easily away from the boot, a feature that may prove quite useful in case the pawl return spring is too strong and therefore likely to interfere with the easy movement of the pawl away from the boot under a mere finger pressure. Furthermore, the device of the present invention is so constituted that the finger extension of the tension lever cannot engage the auxiliary nose of the pawl until the tension lever is opened completely, that is to say, during the sliding movement of the stirrup along the toothed strap, which occurs as a rule when the tension lever is in an intermediate position. In fact, during this action, the pawl must retain the toothed strap.

DESCRIPTION OF THE PREFERRED EMBODIMENTS

Figure 1:
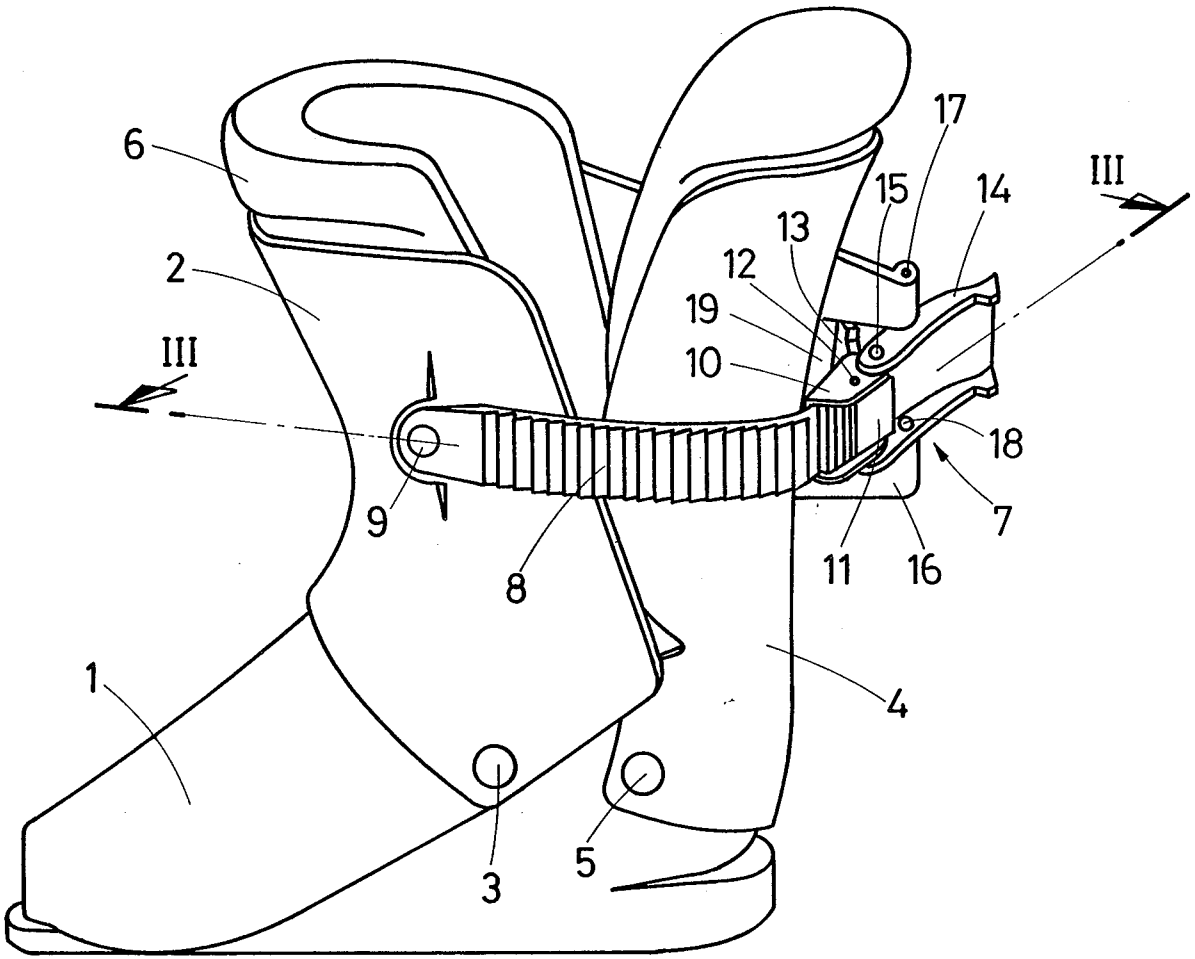
FIG. 1 illustrates a ski boot in its open condition, with a first form of embodiment of the fastener according to the present invention, also shown in its open condition.

The footwear shown in FIGS. 1–4 of the drawings is a ski boot of the rear-access type. It comprises in the known fashion a shell or vamp 1 of synthetic material molded integrally with the sole and surrounding the heel, and a two-section of split shaft 2, 4 fulcrumed thereon. This shaft comprises in fact a front quarter 2 fulcrumed on one side on shell 1 at a point 3 oand on the opposite side at another point (not shown) aligned with said point 3, and a rear quarter 4 fulcrumed at 5 on shell 1 so that it can pivot backward away from the front quarter 2, for opening the boot and enable the skier to put on the boot. The ski boot further comprises a padded inner slipper 6 having likewise a split upper or shaft to permit the opening of the slipper simultaneously with the opening of the boot shaft.

The boot shaft 2, 4 may be held in its closed condition by means of a fastener 7. The boot may also comprise foot tightening means (not shown).

The fastener 7 comprises a toothed strap 8 of relatively hard synthetic material, secured to one side of the front quarter 2 of the boot shaft by means of a rivet 9. Mounted on this toothed strap 8 is a metal stirrup 10 having a pawl 11 pivotally mounted between its wings by means of a transverse pivot pin 12. The toothed strap 8 is inserted between the bottom of stirrup 10 and the nose of pawl 11 is constantly urged against the strap by a torsion spring (not shown) disposed around the pivot pin 12 in the well-known fashion. The toothed strap 8 has ratchet teeth, that is, teeth having a very oblique side face and another side face substantially perpendicular to the strap, so that the stirrup 10 can be moved relative to the strap 8 toward the rivet 9, with the pawl 11 sliding and skipping on the teeth. On the other hand, the pawl 11 is positively locked against movement in the opposite direction. However, it is possible to shift the stirrup 10, or strap 8, by releasing the pawl 11 from the teeth of strap 8 and depressing the other end 11*a* of said pawl. The free end of the toothed strap 8 has a widened portion 13 preventing the toothed strap 8 from escaping from the stirrup 10. Also fulcrumed on said stirrup 10 by means of a pivot pin 15 is one end of a tension lever 14. This tension lever 14 is also fulcrumed intermediate its end by means of a pair of pins 17 and 18 on a lug 16 of the front quarter 2 of the boot shaft. A notch 19 formed in said lug 16 is adapted to receive the tension lever 8 together with its stirrup 10.

Figure 2:
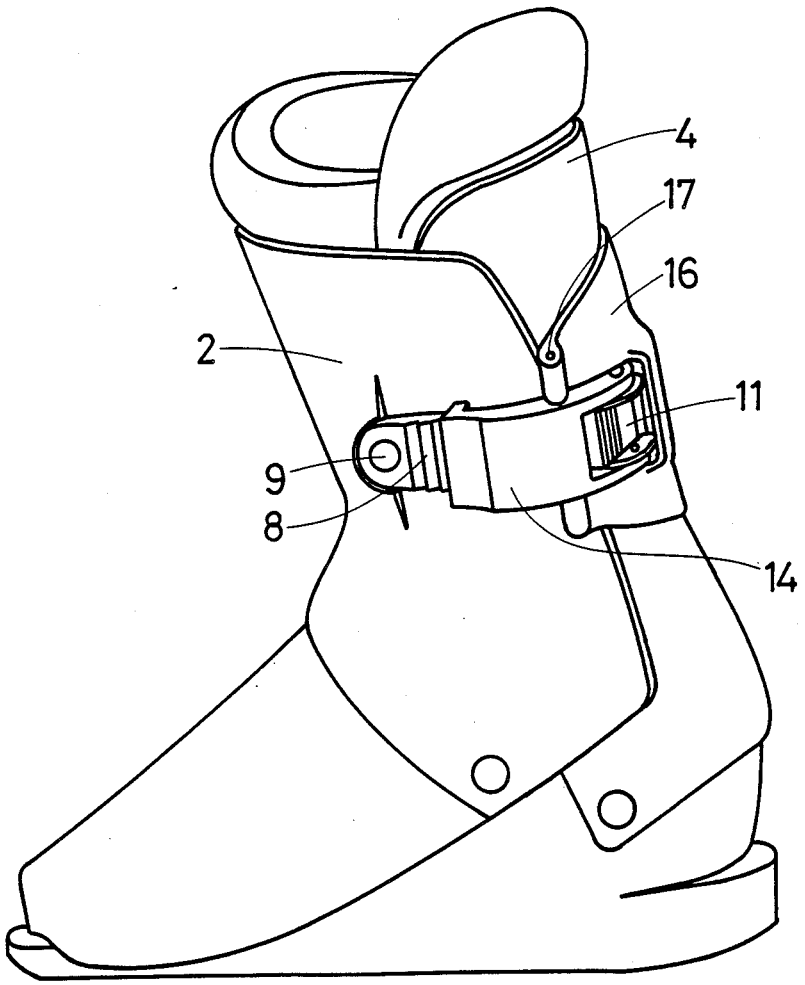
FIG. 2 is a view similar to FIG. 1 showing the same ski boot in its closed position.
Figure 3:
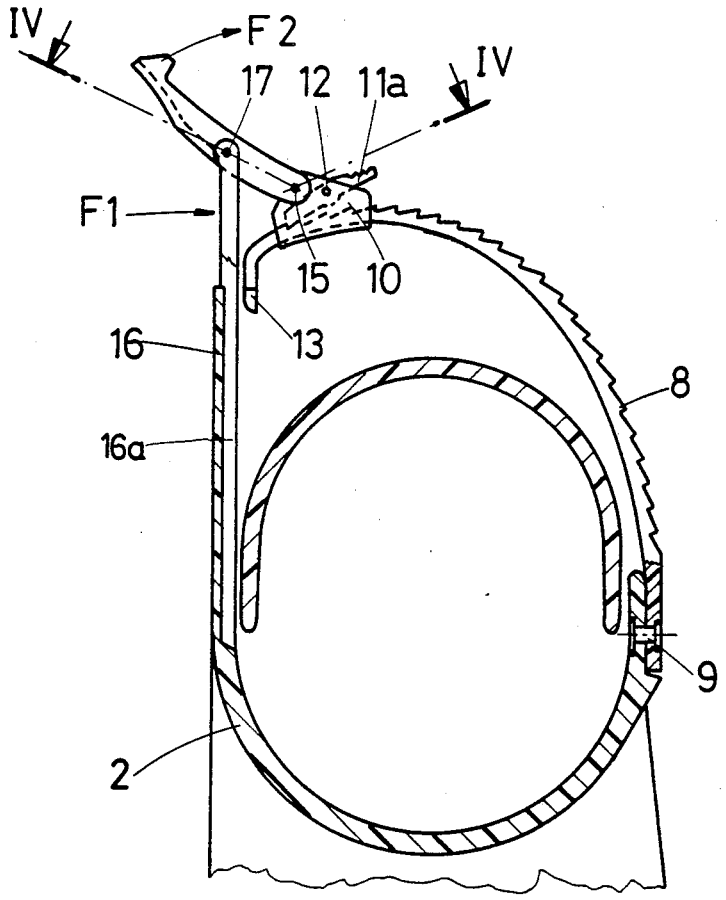
FIG. 3 is a section taken along the line III—III of FIG. 1.
Figure 4:
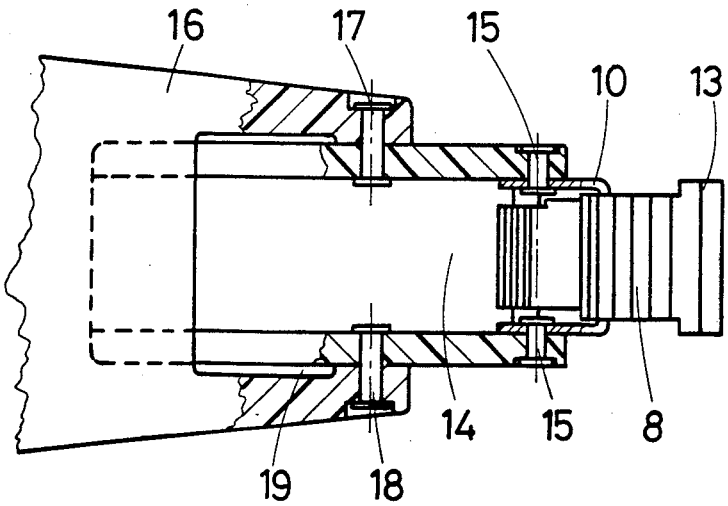
FIG. 4 is a section taken on a larger scale along the line IV—IV of FIG. 3.

To open the boot, the skier simply depresses the heel 11*a* of pawl 11 and pulls the toothed strap 8, generally up to stop means 13. The length of the toothed strap 8 is sufficient to permit a broad opening of the boot shaft. After putting on his boot, the skier closes the shaft and consequently the fastener by firstly depressing the flap 16 of the front quarter 2 in the direction of the arrow F1 (FIG. 3) while retaining the toothed strap 8. Thus, the stirrup 10 can move along the toothed strap 8 toward the rivet 9. The free end 13 of the toothed strap engages under the flap 16 a groove 16*a* formed in this flap. At the end of the closing movement obtained by pulling the stirrup 10, the fastener is closed by means of the tension lever 14 by pivoting this lever clockwise (arrow F2, FIG. 3), until it engages the toothed strap 8. The closed ski boot is shown in FIG. 2, the toothed strap 8 being concealed nearly completely and protected on the one hand by tension lever 14 and on the other hand by the lug or strap 16 of the boot shaft.

If desired, the pivot pins of tension lever 14 may be invented, namely by pivoting the end of this lever on flap 16 of shaft 2, 4 and its middle point on stirrup 10.

Figure 5:
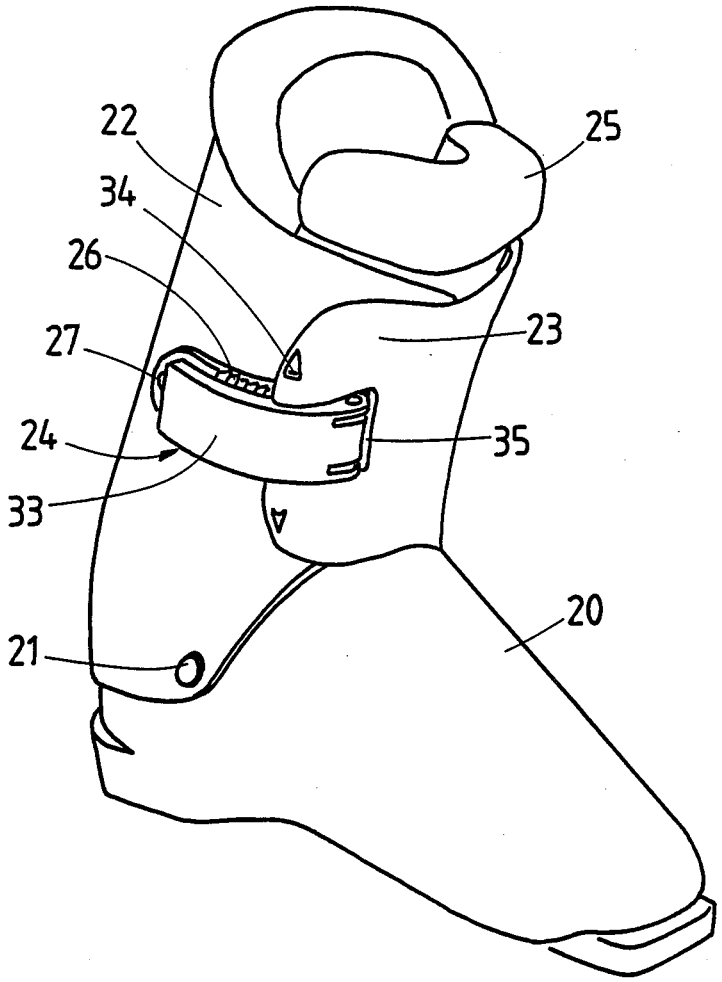
FIG. 5 shows a closed ski boot provided with a modified form of embodiment of the fastener of the present invention.
Figure 6:
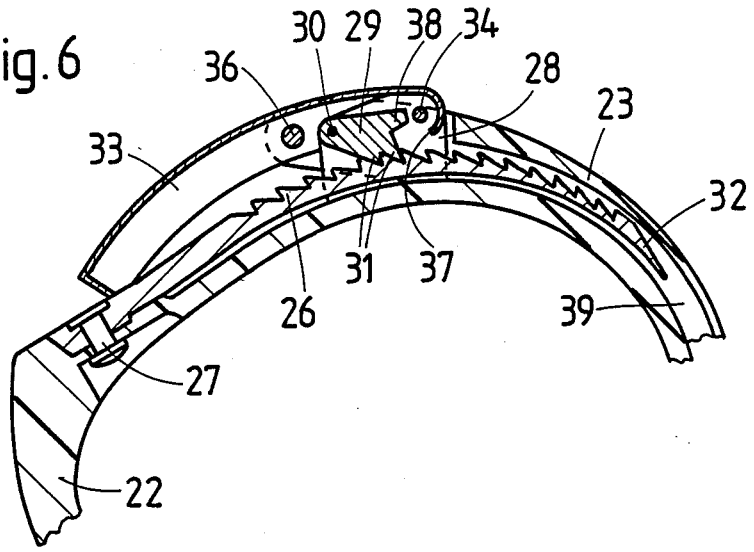
FIG. 6 is a fragmentary section taken along the line II—II of FIG. 5.
Figure 7:
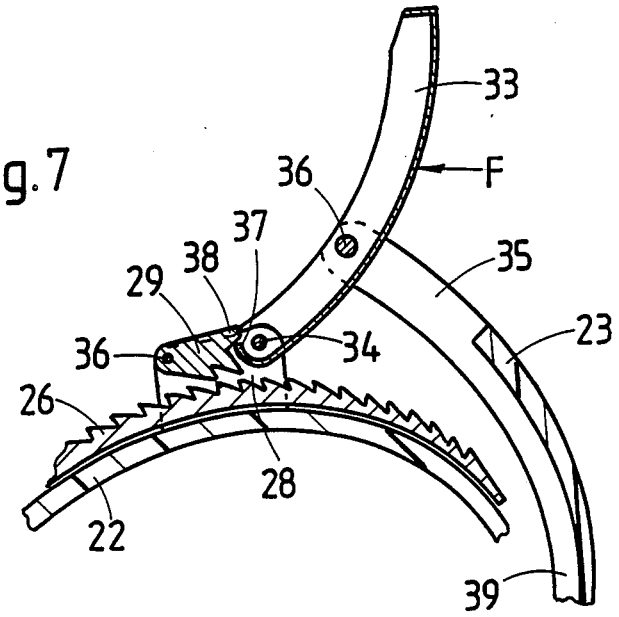
FIG. 7 is a section similar to FIG. 6, but showing the fastener in its open condition.

The footwear illustrated in FIGS. 5–7 of the drawings is of the type adapted to be pulled on from the top. This footwear comprises in the known fashion a shell 20 of synthetic material, formed integrally with the sole and surrounding the heel. The shaft 22 of this footwear is fulcrumed at 21 on shell 20 and comprises a front flap 23 adapted to be closed by means of a fastener 24. This footwear further comprises an inner padded slipper 25 having a split upper to facilitate the introduction of the user's foot. This footwear may also comprise, if desired, foot-or instep-tightening means (not shown).

This fastener 24 comprises likewise a toothed strap 26 having ratchet teeth, and may be made from relatively hard synthetic material. This strap 26 has one end attached by means of a rivet 27 to the shaft 22. Mounted on the toothed strap 26 is a metal stirrup 28 having pivotally mounted, between its lateral wings, and by means of a pivot pin 30, a pawl 29. This pivot pin 30 is disposed near the end of stirrup 28, that is to say, closer to the rivet 27 fixing the toothed strap 26 to the shaft 22. The toothed strap 26 extends between the bottom of stirrup 28 and the double nose 31 of the pawl urged against the toothed strap by a torsion spring (not shown) surrounding said pivot pin 30 in the well-known fashion. The form of the ratchet teeth of strap 26 is such that the stirrup 28 can be moved in the fashion of a runner or slider along the toothed strap 26 toward the rivet 27, the pawl 29 sliding and skipping on the teeth of the toothed strap. On the other hand, the pawl 29 is positively held against movement in the opposite direction. The free end 32 of the toothed strap 26 is widened so that the strap cannot escape from the stirrup 28.

Adjacent the end of stirrup 28 which is opposite pivot pin 30 a tension lever 33 is pivotally mounted by means of a transverse pin 34. This tension lever 33 is furthermore pivoted in a notch 35 of front flap 23 by means of a pin 36. This tension lever 33 consists of a U-section metal member adapted in its closed position to cover and conceal the stirrup 28. This tension lever 33 comprises an extension beyond its pivot pin 34 which constitutes a curved finger 37 directed toward toothed strap 26 and pawl 29. When opening the fastener, this finger 37 of tension lever 33 abuts an auxiliary nose 38 of pawl 29 which extend toward the pin 34 and at the end of a relatively ample angular movement of tension lever 33 said finger 37 moves the pawl 29 away from the toothed strap 26.

When closing the boot, the user pushes the stirrup 28 toward the rivet 27 by actuating the tension lever 33 in the direction of the arrow F (FIG. 7). This angular movement of tension lever 33 is attended immediately by the release of pawl 29 so that this pawl can resume its normal function consisting in retaining the toother strap 26. During this movement, the free end of the toothed strap is inserted under the flap 23 and engages a groove 39 provided for this purpose. At the end of the movement performed by stirrup 28 the fastener is closed by pressing the tension lever 33 against the surface of toothed strap 26. In the closed position, the pawl 29 is concealed completely by tension lever 33.

The above-mentioned fastener can be used for closing any desired and suitable portion of sports footwears or the like.

We claim:

1. Fastener for closing two portions of a footwear, which comprises a toothed strap having ratchet teeth and adapted to be attached to one portion of the footwear, a stirrup provided with a pawl and adapted to be attached to the other portion of the footwear and in which said toothed strap can slide, said toothed strap being held by said pawl against movement in one direction but allowed to move in the opposite direction, and a tension lever, wherein said stirrup is kept continuously in contact with said toothed strap, said tension lever being fulcrumed on said stirrup and providing a permanent coupling between said stirrup and the other portion of the footwear.

2. The fastener of claim 1, wherein said tension lever is fulcrumed at one end of said stirrup.

3. The fastener of claim 2, wherein said pawl is provided with an auxiliary nose extending toward the pivot pin pivotally connecting said tension lever to said stirrup, said tension lever comprising, beyond its pin pivotally connecting said tension lever to said stirrup, an extension constituting a curved finger directed toward said toothed strap and said pawl, whereby when said tension lever is opened said finger drives said pawl through its auxiliary nose away from said toothed strap.

4. The ski boot of claim 1, wherein said pawl comprises an auxiliary nose extending in the direction of the pivot pin of said tension lever on said stirrup and said tension lever has an extension beyond its pivotal mounting on said stirrup, said extension having the configuration of a curved finger in the direction of said toothed strap and said pawl, whereby after opening said tension lever said finger can move said pawl through its auxiliary nose away from said toothed strap.

5. A ski boot having two portions adapted to be closed on each other by means of a fastener comprising a toothed strap having ratchet teeth and adapted to be attached to one portion of the ski boot, a stirrup provided with a pawl and attached to the other portion of the boot and in which said toothed strap is adapted to slide and is retained in one direction by said pawl in the opening direction, and a tension lever, wherein said stirrup is in constant engagement with said toothed strap, said tension lever pivoting on the one hand on said stirrup and on the other hand on the other portion of said boot.

* * * * *